US005934497A

United States Patent [19]

Chang et al.

[11] Patent Number: 5,934,497

[45] Date of Patent: Aug. 10, 1999

[54] SANITARY BEVERAGE CAN LID

[76] Inventors: Charles Chang; Lucy Chang, both of 55 Westview Rd., Wayne, N.J. 07470

[21] Appl. No.: 09/070,056

[22] Filed: Apr. 30, 1998

Related U.S. Application Data

[63] Continuation-in-part of application No. 08/808,108, Feb. 28, 1997, Pat. No. 5,813,561, and application No. 09/009,381, Jan. 20, 1998.

[51] Int. Cl.[6] ..... B65D 17/34

[52] U.S. Cl. ..... 220/269; 220/906

[58] Field of Search ..... 220/268, 269, 220/906

[56] References Cited

U.S. PATENT DOCUMENTS

| | | | |
|---|---|---|---|
| 4,078,695 | 3/1978 | Potts | 220/269 |
| 4,784,283 | 11/1988 | Cantu | 220/269 |
| 4,998,641 | 3/1991 | Willoughby | 220/268 |
| 5,743,445 | 4/1998 | Bennarrouch | 220/269 X |

FOREIGN PATENT DOCUMENTS

| | | | |
|---|---|---|---|
| 0258550 | 10/1990 | Japan | 220/269 |

*Primary Examiner*—Stephen K. Cronin
*Attorney, Agent, or Firm*—Richard A. Joel, Esq.

[57] ABSTRACT

A flat end beverage can lid comprises a soda can lid wherein the inner platform is connected with the rim groove. The intent is to facilitate cleaning of the groove and nearby opening hole. The pull tab is located on the inner platform so that it can be readily cleaned by finger. The inner platform extends to the can edge and can be lower than or equal to the rim groove. With this design, it is also possible to use the existing crimping head on the filling line which represents a large cost savings for the filler.

8 Claims, 1 Drawing Sheet

SANITARY BEVERAGE CAN LID

This application is a continuation-in-part of application 08/808,108 filed Feb. 28, 1997, now U.S. Pat No. 5,813,561 and 09/009,381 filed Jan. 20, 1998, now pending.

BACKGROUND OF THE INVENTION

This invention relates to beverage cans for soft drinks, beer, juices and the like, with pull off tabs on the upper lid thereof. In particular, the invention is concerned with a sanitary lid wherein the individual drinking directly from the can does not come in contact with the dirt and debris which is likely to accumulate in the rim groove. The invention discloses a lid design which facilitates cleaning near the opening.

This invention is designed to provide a sanitary beverage can lid which eliminates the problems associated with can lids of the prior art. The prior art is rather voluminous but it is not believed that the specific invention disclosed herein is anticipated by any of the prior art patents.

In the prior art, U.S. Pat. No. 4,262,815 to Klein, discloses a conical can with an opening tab at the cone apex merely for nesting purposes. This patent discloses a rather complicated conical can end with a different type pull tab. Klein is not concerned with applicant's flat end can. Further, a critical problem with this conical can is the fact that the weight of stacked-up cases will be borne by the conical neck in warehousing and shipping. This requires a very thick and strong material, such as steel, for the conical neck. Also, the design introduces stress to the crimped seal between the neck and the can body whereas in the present invention the cans are stacked on the crimped rim which eliminates the necessity of extra strong lid material and permits the use of recyclable aluminum lids. In contrast to Klein, less space is required in shipping and storage.

U.S. Pat. Nos. 5,108,003 and 5,119,955 to Granofsky disclose the use of a complimentary cover for a beverage can in order to permit sanitary drinking from a can.

U.S. Pat. No. 4,895,270 to Main discloses a sanitary cover for a pop top beverage container comprising an elastic membrane extending over the top and axially along a portion of the side wall of the container.

In another type of container, U.S. Pat. No. 3,946,895 to Pugh discloses a container lid with a tear closure and a straw. Another interesting but different proposal for a sanitary drinking can is disclosed in U.S. Pat. No. 4,114,778 to O'Neal which provides an interiorally attached sanitary drinking spout within the container.

Also of interest are U.S. Pat. Nos. 2,547,059 4,407,425; 4,047,634; 3,300,081; 4,318,493; and, 5,415,313.

Applicants pending applications Ser. No. 08/808,108 and Ser. No. 09/009,381 both deal with designs to clean or avoid the deep groove about the rim edge which accumulates debris. The solution proposed by applicants in the pending applications involved unique double rim designs.

The foregoing prior art patents disclose various can lids and means for providing a sanitary can opening for drinking directly from a container. The unique concepts proposed by applicants herein are nowhere seen or suggested in these particular references.

SUMMARY OF THE INVENTION

The present invention relates to beverage cans and in particular to a new and improved flat end sanitary drinking can which facilitates cleaning near the opening.

The invention includes a lid which is positioned over the main exterior cylindrical surface of a beverage container and includes an inner platform which connects to the rim groove. The pull tab is located on the inner platform so that it can be readily cleaned by finger. The inner platform extends to the can edge and can be lower than or equal to the groove depth. As a result, an individual's mouth does not come in contact with the debris accumulating groove adjacent the rim. The part of the lid contacted by an individual in drinking directly from the can may be readily cleaned. In another embodiment, an extremely wide groove may be included to facilitate cleaning.

Another advantage of the present invention is the fact that it is possible to use the existing crimping head on the filler line. This represents a large cost savings for the filler.

Accordingly, it is an object of this invention to provide a new and improved sanitary lid for a beverage container.

Another object of this invention is to provide a new and improved lid for a flat end beverage can wherein the lid center platform extends to the can edge to facilitate cleaning.

Another object of this invention is to provide a new and improved flat end beverage can lid wherein the inner platform connects to the rim groove and wherein the existing crimping head on the filler line can be used with the design.

A still further object of this invention is to provide a wide rim groove on a new and improved sanitary beverage can lid to facilitate cleaning.

Another object of this invention is to provide a new and improved beverage can lid wherein the recessed pull tab area is lower than or equal to the rim depth.

A more specific object of this invention is to provide a new and improved beverage can lid wherein the center platform can be close to or equal to the depth of the rim groove to facilitate cleaning and said platform extends to the lid edge on a segmented portion of the lid.

BRIEF DESCRIPTION OF THE DRAWINGS

The above and other objects and advantages of the invention may be more clearly shown when viewed in conjunction with the accompanying drawings wherein.

DETAILED DESCRIPTION OF THE INVENTION

Figure 1:
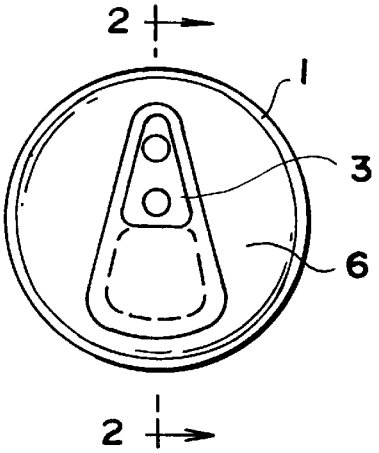
FIG. 1 PRIOR ART
FIG. 1 is a top view of an existing can lid representing the prior art.
Figure 2:
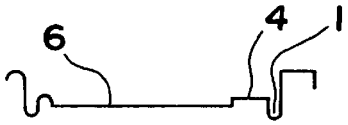
FIG. 2 PRIOR ART
FIG. 2 is a cross-sectional view of the prior art lid taken along the line 2—2 of FIG. 1.

Referring now to the drawings, the invention comprises a unique sanitary can lid which may be readily cleaned to eliminate dirt and debris problems associated with the deep rim groove 1 of FIGS. 1 and 2. The traditional soda can lid is disclosed with the groove 1 extending completely about the can and the pull tab 3 being located on the center platform 4. To overcome the cleaning problems, applicant has developed a double rim design illustrated in his co-pending applications, Ser. No. 08/808,108 and Ser. No. 09/009,381.

Figure 3:
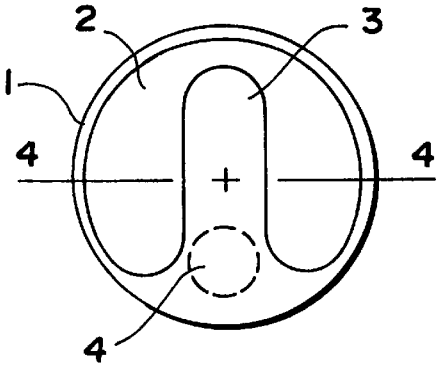
FIG. 3 is a top view of the sanitary beverage can lid comprising the invention.
Figure 4:
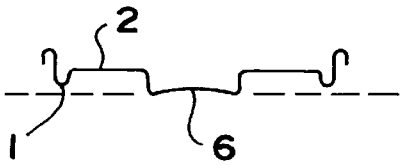
FIG. 4 is a cross-sectional view of the invention taken along the lines of 4—4 of FIG. 3.
Figure 5:
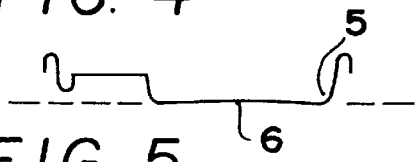
FIG. 5 is a cross-sectional view of the invention taken along the lines of 5—5 of FIG. 3.
Figure 6:
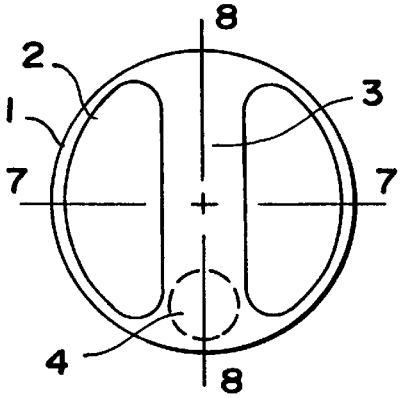
FIG. 6 is a top view of an alternate embodiment of the invention with the recessed pull tab area connected to the groove in both directions.

The present invention, illustrated in FIGS. 3–5 includes a raised platform 2 and a recessed pull tab area 3 connecting with the rim groove 1 in a segment of the circular lid 10. The pull tab 2 and perforated opening 4 are located on the recessed area 5 which is surrounded by the center platform 2. The scored opening 4 extends outwardly from the pull tab (not shown) to the vicinity of the lid edge 11. The opening 4 may be readily cleaned since the deep rim groove 1 does not extend completely about the lid 10. This fact is clearly shown in FIGS. 3–5.

The bottom 6 of the recessed area 3 may be lower than or substantially equal to the depth of the groove 1. FIG. 4 shows the bottom 6 lower than the groove 1 but it is to be understood that the bottom could be substantially equal or close to the lower portion of the groove 1. The important point is illustrated in FIG. 5 wherein the radius 5 may be readily cleaned by hand with one using their finger or otherwise.

Figure 7:
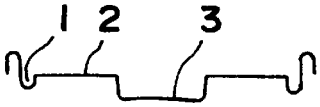
FIG. 7 is a view of the lid in FIG. 6 taken along the lines 7—7 of FIG. 6.
Figure 8:
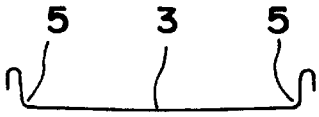
FIG. 8 is a view of the invention taken long the lines 8—8 of FIG. 6.

FIG. 7 discloses an alternate embodiment wherein the recessed pull tab area 3 is connected with the groove 11 on the opposite sides of the lid 10. This provides ease of opening and as shown in FIG. 8 the radius 5 and the opening area may be readily cleaned.

Figure 9:
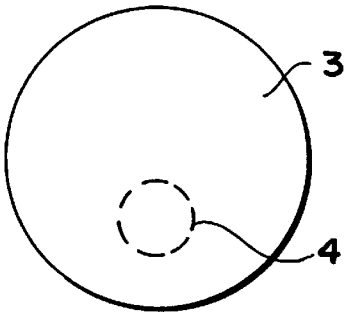
FIG. 9 is an alternate embodiment of the invention wherein the recessed pull tab area covers the entire lid; and, FIG. 10 is a further embodiment of the invention disclosing a large groove for ease of cleaning.

FIG. 9 discloses an alternate embodiment wherein the pull tab area 3 and the opening 4 cover the entire lid 10. The lid 10 may either be flat or slightly domed or slightly domed with a recessed center for easy cleaning and to add structural strength.

Figure 10:
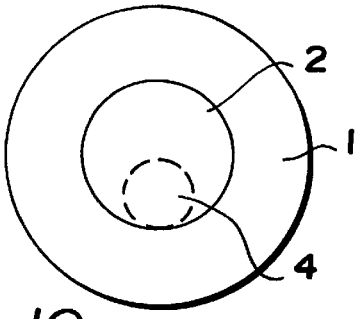

FIG. 10 discloses a further embodiment of the invention with a large groove 1 surrounding the center platform 2 for ease of cleaning.

While the invention has been explained by a detailed description of certain specific embodiments, it is understood that various modifications and substitutions can be made in any of them within the scope of the appended claims which are intended also to include equivalents of such embodiments.

What is claimed, is:

1. A flat end beverage can lid for a hollow container:

an outer edge crimped over the hollow container; and, a narrow rim groove having container extending substantially thereabout and said groove extending downwardly to a predetermined depth;

a raised center platform extending upwardly from the narrow groove; and, a centrally recessed pull tab area extending downwardly to a point substantially equal or close to the groove depth and then outwardly connecting to the rim groove said area thereby facilitating cleaning.

2. A flat end beverage can lid for a hollow container said flat end comprising:

an outer edge crimped over the hollow container; and, a narrow rim groove having the container extending substantially thereabout and said groove extending downwardly to a predetermined depth;

a raised center platform extending upwardly from the narrow groove; and, a centrally recessed pull tab area extending downwardly to a point substantially equal or close to the groove depth and then outwardly connecting to the rim groove to provide an upward radius said area facilitating cleaning wherein the recessed pull tab area is lower than the groove depth.

3. A flat end beverage can lid for a hollow container said flat end comprising:

an outer edge crimped over the hollow container; and, a narrow rim groove having the container extending substantially thereabout and said groove extending downwardly to a predetermined depth;

a raised center platform extending upwardly from the narrow groove; and, a centrally recessed pull tab area extending downwardly to a point substantially equal or close to the groove depth and then outwardly connecting to the rim groove to provide an upward radius said area facilitating cleaning wherein the recessed pull tab area is close to or equal to the groove depth.

4. A flat end beverage can lid for a hollow container in accordance with claim 2 or 3 wherein:

the recessed pull tab area is connected to the groove at opposite ends of the lid.

5. A flat end beverage can lid for a hollow container in accordance with claim 2 or 3 wherein:

the recessed pull tab area extends transversely across the lid and is joined to the rim groove at opposite ends to provide ease of opening and facilitate cleaning.

6. A flat end beverage can lid for a hollow container in accordance with claim 2 or 3 wherein:

the rim groove is relatively large to easily permit cleaning with the finger.

7. A flat end beverage can lid for a hollow container in accordance with claim 2 or 3 wherein:

the recessed portion extends over entire lid with a large radius at the outer end thereof extending upwardly to the rim.

8. A flat end beverage can lid for a hollow container in accordance with claim 7 wherein:

the recessed portion is slightly domed to facilitate cleaning and to add structure strength.

* * * * *